US008925134B2

(12) United States Patent
Vosbikian et al.

(10) Patent No.: US 8,925,134 B2
(45) Date of Patent: Jan. 6, 2015

(54) ROTATING CLEANING DEVICE

(75) Inventors: Peter S. Vosbikian, Moorestown, NJ (US); Vince Cella, Medford, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 2760 days.

(21) Appl. No.: 11/361,205

(22) Filed: Feb. 24, 2006

(65) Prior Publication Data

US 2007/0199169 A1 Aug. 30, 2007

(51) Int. Cl.

| | |
|---|---|
| ***A47L 13/10*** | (2006.01) |
| ***A46B 7/02*** | (2006.01) |
| ***A46B 5/00*** | (2006.01) |
| ***A47L 13/12*** | (2006.01) |

(52) U.S. Cl.

CPC ..... *A46B 7/02* (2013.01); *A46B 5/0008* (2013.01); *A46B 5/0075* (2013.01); *A46B 5/0083* (2013.01); *A47L 13/12* (2013.01); *A46B 2200/302* (2013.01)

USPC ..... 15/106; 15/159.1

(58) Field of Classification Search

USPC ..... 15/106, 159.1, 160, 171, 172, 228, 15/209.1

See application file for complete search history.

(56) References Cited

U.S. PATENT DOCUMENTS

| | | | | |
|---|---|---|---|---|
| 375,154 | A | 12/1887 | Hawkins | |
| 594,509 | A * | 11/1897 | Ackerman | 15/49.1 |
| 1,881,431 | A | 12/1927 | Finnell | |
| 2,119,386 | A | 8/1934 | Holm-Hansen et al. | |
| 2,701,888 | A | 6/1949 | Vosbikian et al. | |
| 2,748,408 | A | 11/1951 | Zaiger et al. | |
| 2,671,918 | A * | 3/1954 | Jones | 15/106 |
| 2,895,152 | A * | 7/1959 | Vosbikian et al. | 15/116.2 |
| 3,451,092 | A * | 6/1969 | Szopo | 15/106 |
| D358,487 | S | 5/1995 | Kneesch et al. | |
| 5,485,648 | A * | 1/1996 | Balducci et al. | 15/175 |
| 5,517,710 | A * | 5/1996 | Hisey | 15/106 |
| 5,867,857 | A | 2/1999 | Crouser et al. | |
| 6,128,800 | A | 10/2000 | Vosbikian | |
| 6,385,808 | B1 * | 5/2002 | Yamada et al. | 15/167.1 |
| 6,438,784 | B1 * | 8/2002 | Yu | 15/106 |
| 6,564,417 | B2 * | 5/2003 | Porat | 15/179 |
| 6,606,756 | B2 * | 8/2003 | Fernandez | 15/111 |
| 6,640,386 | B2 | 11/2003 | Morgan et al. | |
| 6,792,648 | B2 | 9/2004 | Lee | |
| 6,871,372 | B2 | 3/2005 | Vosbikian | |
| 2002/0029433 | A1 | 3/2002 | Libman | |
| 2003/0217426 | A1 | 11/2003 | Petner | |
| 2003/0221281 | A1 | 12/2003 | Oh | |
| 2004/0031116 | A1 * | 2/2004 | Coleman | 15/172 |
| 2004/0031123 | A1 | 2/2004 | Sclafani et al. | |
| 2004/0098820 | A1 | 5/2004 | Williams et al. | |
| 2005/0086756 | A1 | 4/2005 | Petner | |

* cited by examiner

*Primary Examiner* — Robert Scruggs
(74) *Attorney, Agent, or Firm* — Archer & Greiner, P.C.; Gregory J. Winsky; Jason F. Cotter

(57) ABSTRACT

A cleaning implement is disclosed which provides a cleaning member rotatably connected to a base member. Attached to the base member is a first cleaning material, while a second cleaning material is attached to the cleaning member. The second cleaning material may be oriented in a different plane than the first cleaning material, allowing differently oriented surfaces to be cleaned. The cleaning member is adapted to rotate relative to the base member to allow the cleaning member to be oriented in a multitude of cleaning configurations. A method of cleaning, utilizing the cleaning implement of the invention, is also disclosed.

38 Claims, 6 Drawing Sheets

ROTATING CLEANING DEVICE

BACKGROUND

Conventional cleaning devices, such as brushes, brooms, scrubbers, mops, and sponges, often lack the ability to reach differing oriented surfaces as a result of their cleaning material being oriented in a fixed configuration.

A cleaning device, and method for its use, is needed which will allow a user to orient the cleaning material of the cleaning device into differing configurations in order to clean variably oriented surfaces.

SUMMARY

In one aspect of the invention, a cleaning implement is disclosed comprising a base member, a first cleaning material attached to the base member, a cleaning member rotatably connected to the base member, and a second cleaning material attached to the cleaning member. The second cleaning material is oriented in a different plane than the first cleaning material.

In another aspect of the invention, a cleaning implement is disclosed comprising a handle, a base member connected to the handle, a first cleaning material attached to the base member, a cleaning member rotatably attached to the base member, two or more receiving surfaces defined in the base member, and a second cleaning material attached to the cleaning member. The cleaning member is adapted to rotate relative to the base member for positioning the cleaning member into two or more cleaning positions relative to the base member.

In yet another aspect of the invention, a method of cleaning utilizing a cleaning implement is disclosed. The method comprises providing a cleaning implement including a base member, a first cleaning material attached to the base member, a cleaning member connected to the base member, and a second cleaning material attached to the cleaning member. The cleaning member is oriented into a first cleaning position relative to the base member, and then rotated into a second fixed cleaning position relative to the base member.

The present invention, together with further objects and advantages, will be best understood by reference to the following detailed description taken in conjunction with the accompanying drawings.

DETAILED DESCRIPTION OF THE PREFERRED EMBODIMENTS

The following description of preferred embodiments provides examples of the present invention. The embodiments discussed herein are merely exemplary in nature, and are not intended to limit the scope of the invention in any manner. Rather, the description of these preferred embodiments serves to enable a person of ordinary skill in the art to use the present invention.

Figure 1:
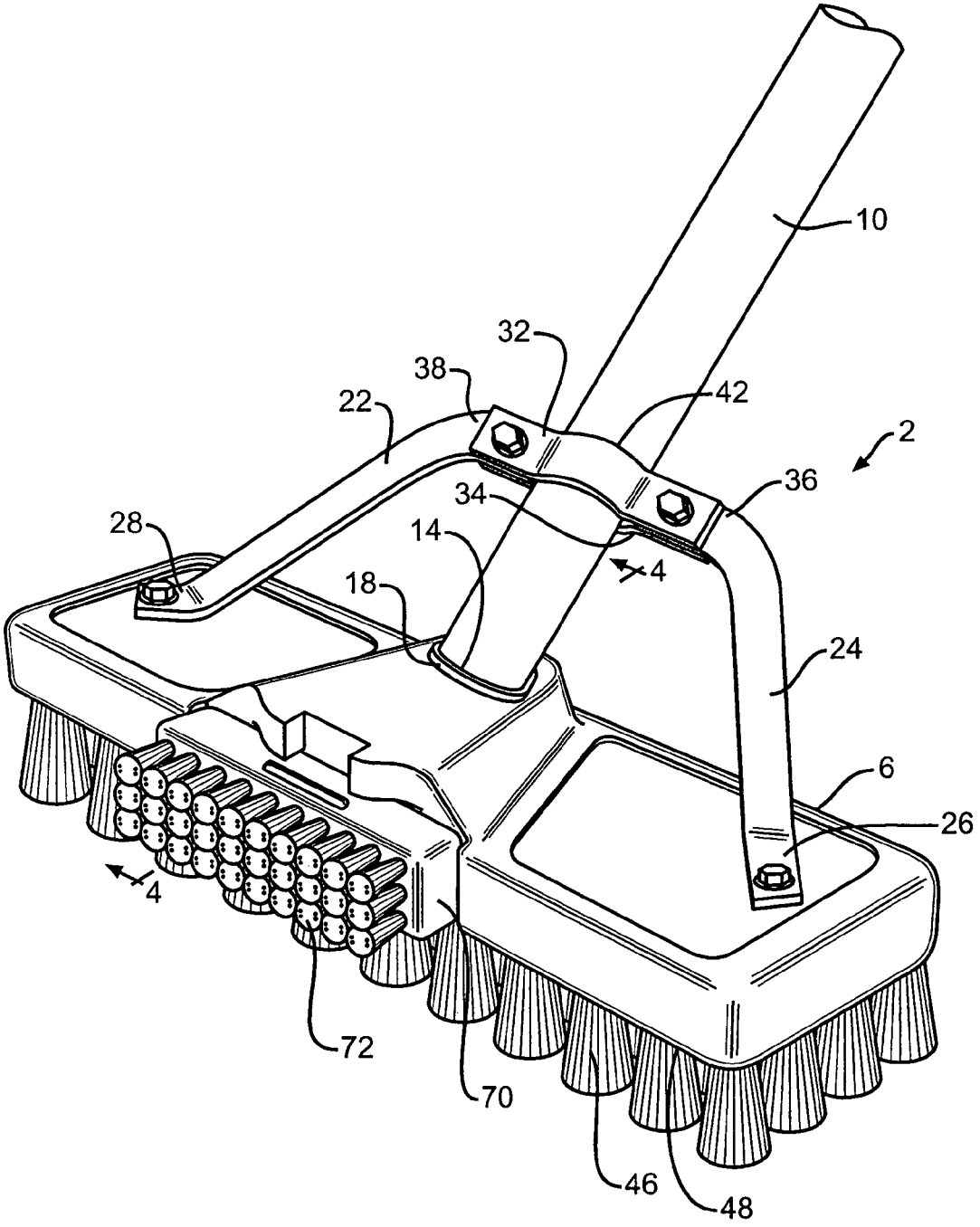
FIG. 1 is a frontal perspective view of one embodiment of the cleaning implement of the present invention with the rotatable cleaning member in a horizontal position along the base member.

FIG. 1 depicts one embodiment of the present invention. Cleaning implement 2 comprises a base member 6 and handle 10. The base member 6 is made of foam filled Polypropylene while the handle 10 is made of wood. In other embodiments, the base member 6 and handle 10 may be made of any material known in the art, such as any type of wood, plastic, or metal.

The handle 10 is secured to the base member 6 as a result of an end 14 of the handle 10 being threaded into a hole 18 in the base member 6. In other embodiments, the handle 10 may be connected to the base member 6 by any mechanism known in the art, such as through the utilization of bolts or snap-fits. Stabilizing arms 22 and 24 extend from the handle 10 to the base member 6 to assist in stabilizing the connection of the handle 10 to the base member 6. Ends 26 and 28 of the stabilizing arms 22 and 24 are bolted to the base member 6. Metal connection members 32 and 34 run between, and are bolted to, the other ends 36 and 38 of the stabilizing arms 22 and 24. The handle 10 extends through a substantially circular aperture 42 formed between the connection members 32 and 34. In other embodiments, other mechanisms known in the art may be used to stabilize the connection between the handle 10 and the base member 6.

Bristles 46 extend substantially perpendicularly from a bottom surface 48 of the base member 6. The bristles 46 are made of Polypropylene. In other embodiments, the bristles 46 may be made of any material and in any configuration known by those skilled in the art. In still other embodiments, instead of having bristles 46 for use as a brush, scrubber, or broom, the base member 6 may comprise a mop head, sponge head, or other type of head known in the art, having strands or other material, emanating from the base member 6 made for mopping, sponge usage, or other usage known in the art. In additional embodiments, the base member 6 itself may not have any capacity for acting as a brush, scrubber, broom, mop, or sponge, but instead may be connected to a member having such capacity.

Figure 2:
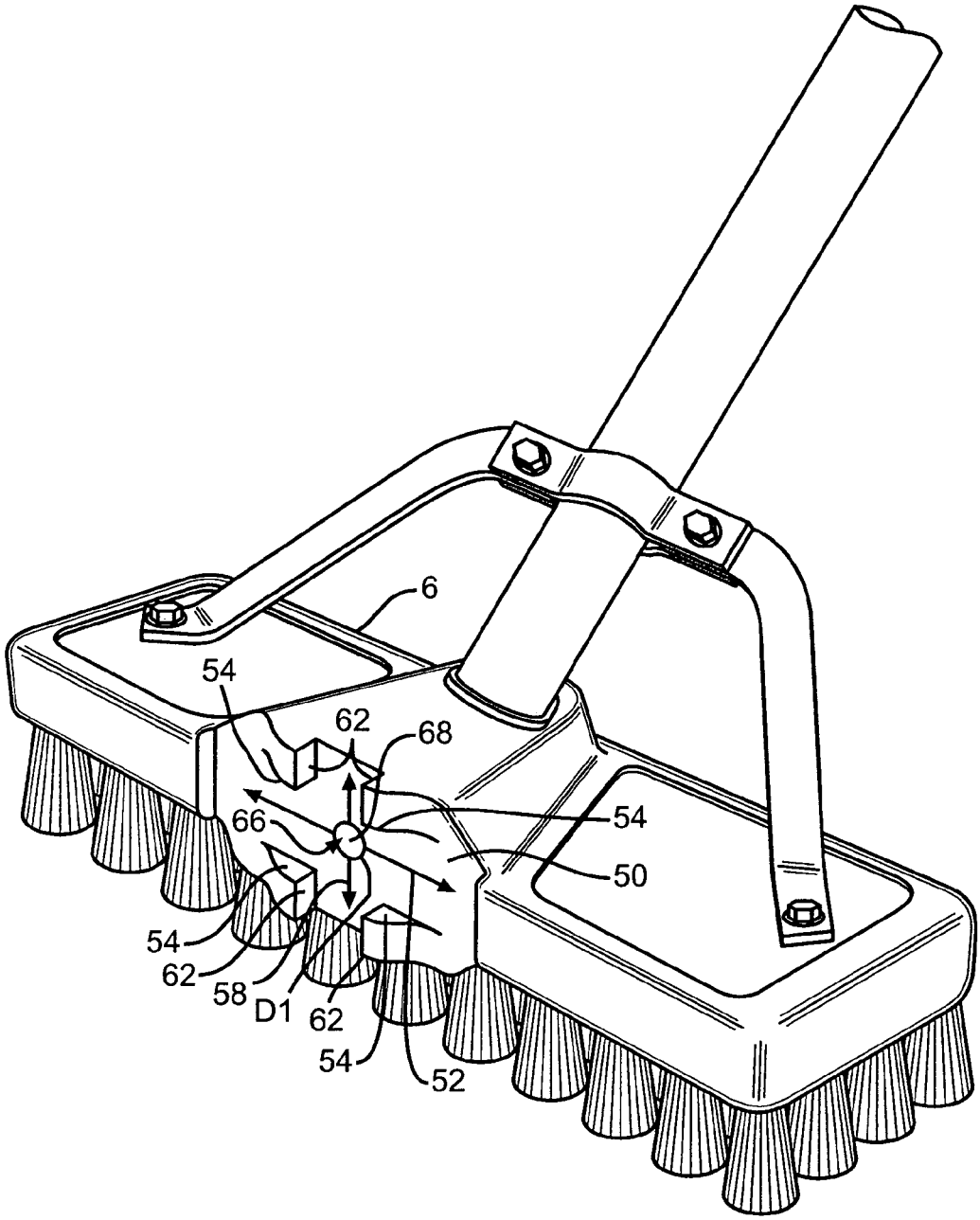
FIG. 2 is a frontal perspective view of the base member of FIG. 1.
Figure 6:
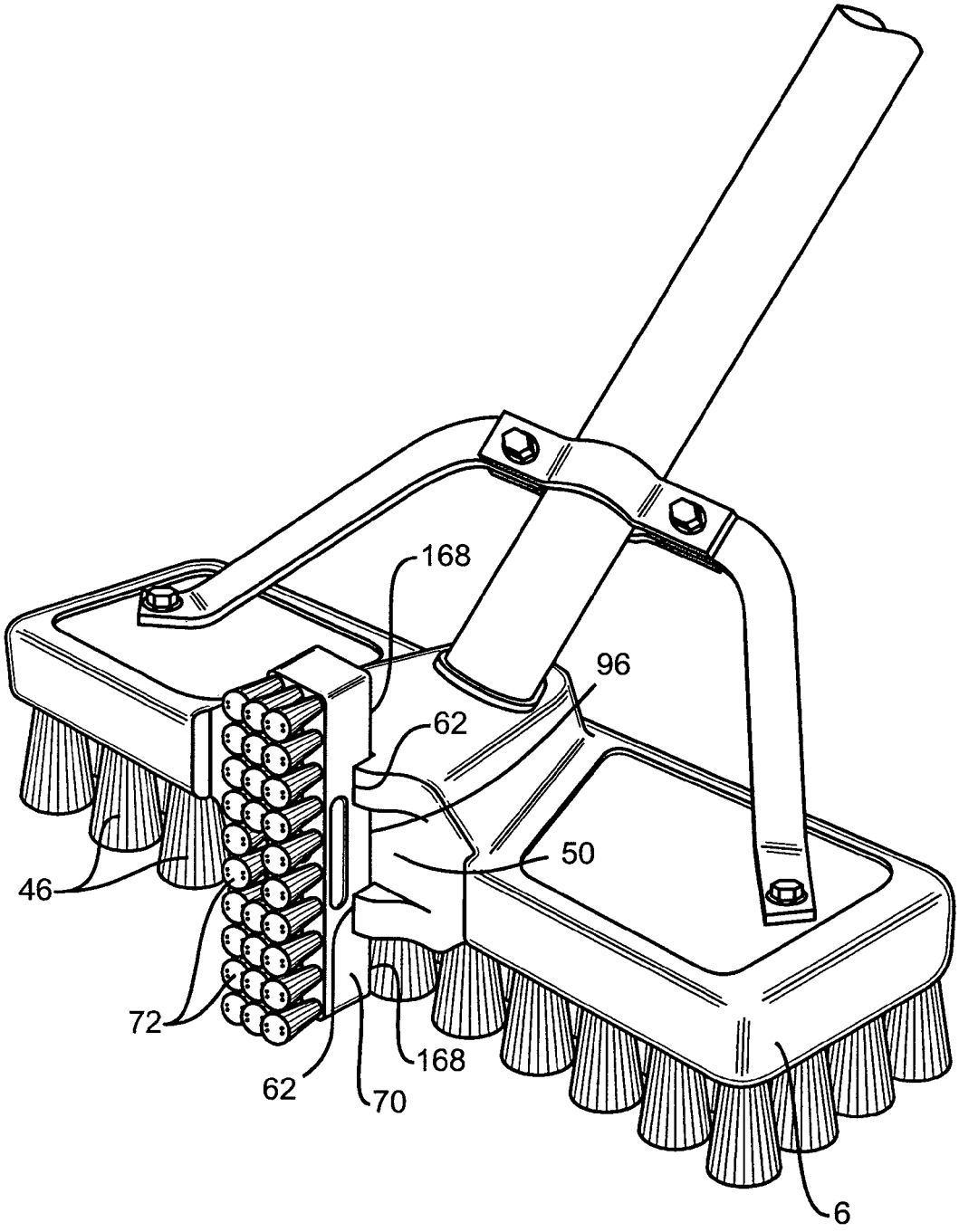
FIG. 6 is a frontal perspective view of the cleaning implement of FIG. 1 with the rotatable cleaning member in a vertical position along the base member.

As shown in FIGS. 1 and 2, the base member 6 is substantially rectangular, but in other embodiments may be in any shape known in the art. A front surface 50 of the base member 6 contains a horizontal pathway 52 cut into the front surface 50. The horizontal pathway 52 is partially surrounded by ridges 54. A vertical pathway 58 is also cut into the front surface 50 of the base member 6. Abutments 62 partially line the vertical pathway 58. In a location 66 where the horizontal pathway 52 and vertical pathway 58 intersect, a hole 68 of diameter D1, used for the attachment of a cleaning member 70, extends from the front surface 50 partially into the cross-section of the base member 6. The horizontal and vertical pathways 52 and 58 are configured to accommodate attachment of the cleaning member 70 to allow the cleaning member 70 to be held in both a horizontal position, as shown in FIG. 1, and a vertical position, as shown in FIG. 6. In such manner, the cleaning member may be utilized to clean surfaces in planes other than the plane of the surface oriented directly under the brush member. In other embodiments, one or more pathways along any surface of the base member 6, in any type of configuration, may be utilized to hold the cleaning member 70 in any desired position.

In still other embodiments, the base member 6 may comprise two or more receiving surfaces, in any location or configuration, which are adapted to receive the cleaning member 70 against the receiving surfaces. The receiving surfaces may comprise any type of arrangement adapted to receive the cleaning member 70, such as a portion of a male and female arrangement, a portion of a slot and groove arrangement, and a portion of a ball and socket arrangement. The receiving surfaces may be utilized to receive the cleaning member 70 in a multitude of different orientations and positions, such as horizontal, vertical, and angular. The receiving surfaces may also be adapted to restrain the cleaning member 70 in one or more directions when the cleaning member 70 is against the receiving surfaces.

FIGS. 3, 3A, 3B, and 3C depict various views of the cleaning member 70. The cleaning member 70 is made of foam filled Polypropylene and is substantially rectangular. In other embodiments, the cleaning member 70 may be made of any material known in the art and may be in any configuration. Polypropylene bristles 72 extend substantially perpendicularly from a front surface 76 of the cleaning member 70. In other embodiments, the bristles 72 may be made of any known material and in any location or configuration. The bristles 72 may be used to sweep, scrub, or brush during cleaning. In still other embodiments, the cleaning member 70 may comprise a sponge head or other type of cleaning head having material emanating from the cleaning member 70 made for sponge or other cleaning usage.

Figure 3:
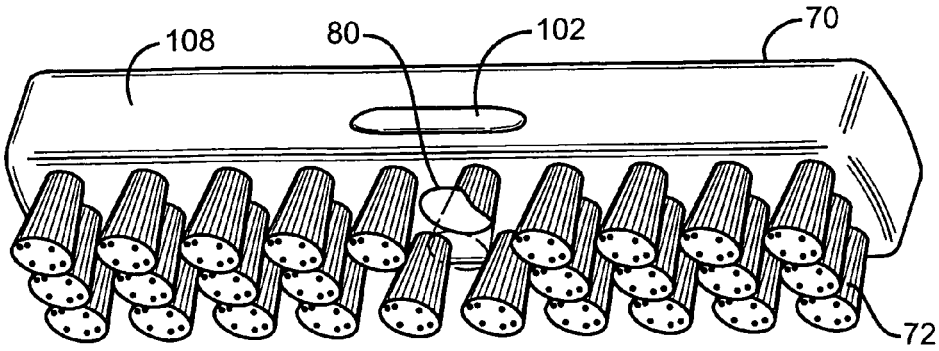
FIG. 3 is a frontal perspective view of the rotatable cleaning member of FIG. 1.
Figure 3A:
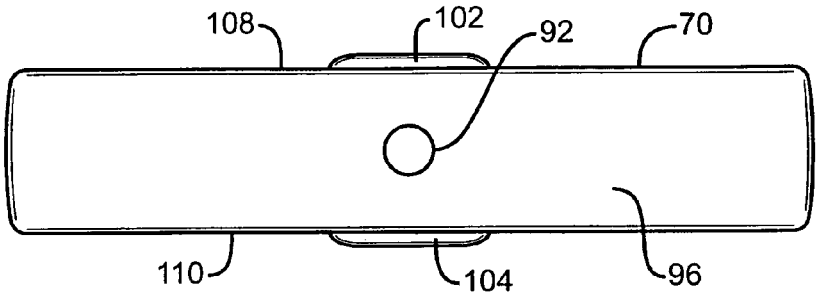
FIG. 3A is a back plan view of the cleaning member of FIG. 1.
Figure 3B:
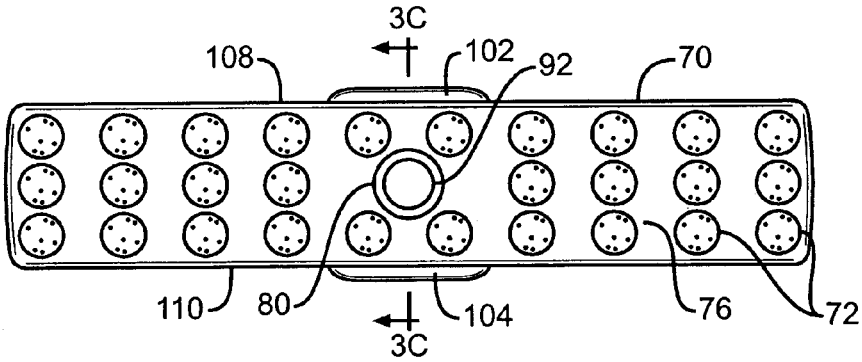
FIG. 3B is a bottom plan view of the cleaning member of FIG. 1.
Figure 3C:
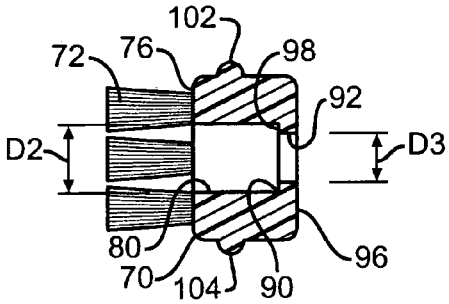
FIG. 3C is a partial cross-sectional view of the cleaning member of FIG. 3B along line 3C-3C.

As shown best by FIG. 3C, which is a partial cross-sectional view of the cleaning member 70 taken along line 3C-3C of FIG. 3B, a substantially circular aperture 80 of diameter D2 extends from the front surface 76 of the cleaning member 70 partially through the cross-section of the cleaning member 70. At the location 90 in the cross-section where the aperture 80 ends, a substantially circular aperture 92, of smaller diameter D3 than the diameter D2 of the aperture 80, extends through the remaining cross-section and through the back surface 96 of the cleaning member 70. In such manner, a shoulder 98 is formed within the cross-section of the cleaning member 70. Gripping members 102 and 104 extend from side surfaces 108 and 110 of the cleaning member 70. In other embodiments, the cleaning member 70 may utilize one or more apertures or gripping members in any location, size, alignment, or configuration.

Figure 4:
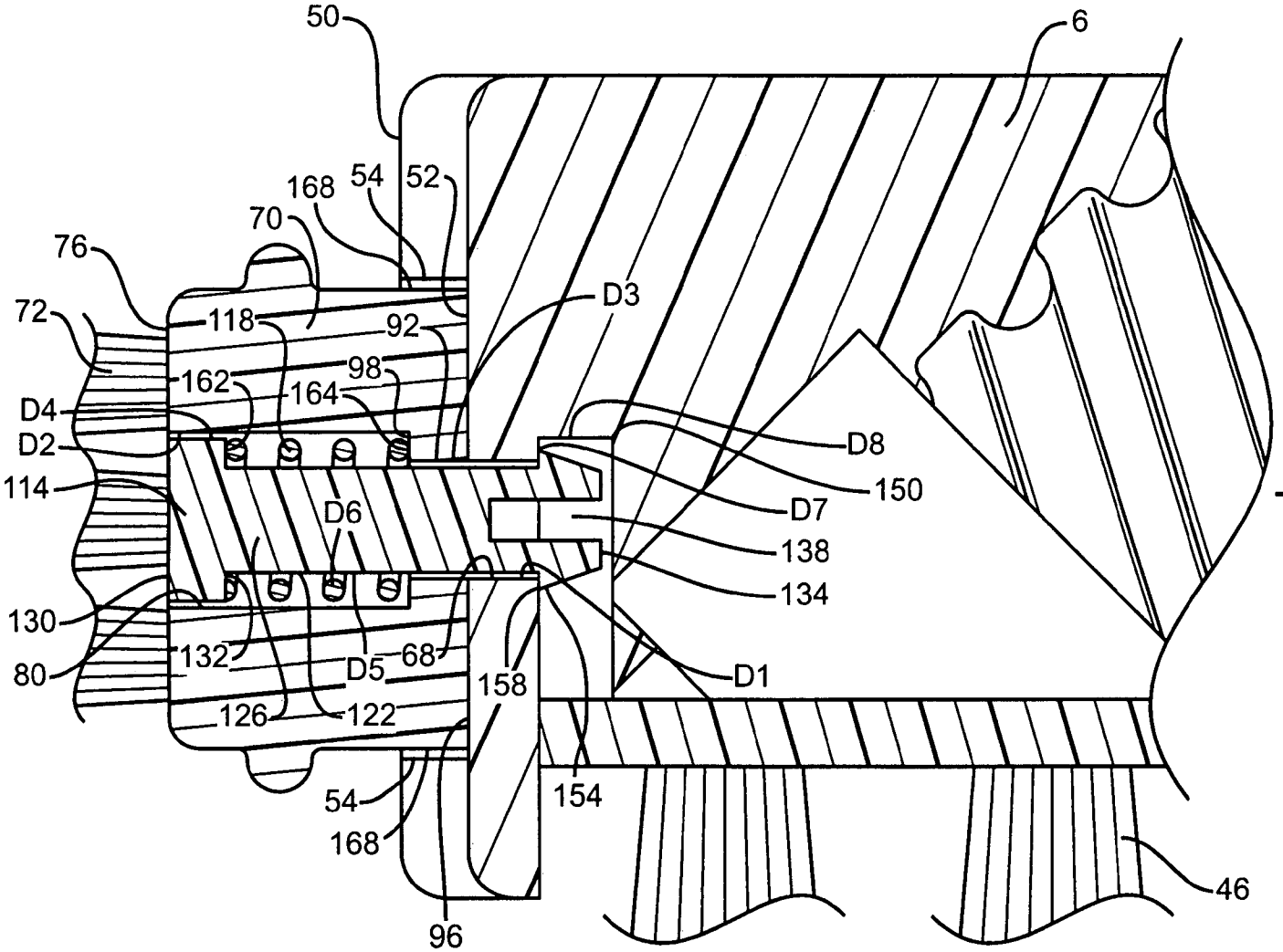
FIG. 4 is a partial cross-sectional view of the cleaning implement of FIG. 1 along line 4-4 showing a cross-section of the cleaning member and base member.

FIG. 4 shows a partial cross-sectional view taken along line 4-4 of FIG. 1 to demonstrate the attachment of the cleaning member 70 to the base member 6 in a horizontal position as a result of the horizontal pathway 52. To attach the cleaning member 70 to the base member 6, a nylon pin member 114, having a steel spring 118 extending around an inner portion 122 of the nylon pin member's shaft 126, is inserted into the substantially circular aperture 80 in the front surface 76 of the cleaning member 70. In other embodiments, the pin member 114 and spring 118 may be of differing material, shapes, sizes, locations, and configurations. In further embodiments, other mechanisms may be utilized to attach the cleaning member 70 to the base member 6.

The nylon pin member 114 has an end portion 130 of smaller diameter D4 than the diameter D2 of the aperture 80 in the front surface 76 of the cleaning member 70 to allow insertion into the cleaning member 70. At the same time, the diameter D4 of the end portion 130 of the nylon pin member 114 is larger than the diameter D3 of the aperture 92 in the back surface 96 of the cleaning member 70 to prevent the end portion 130 of the nylon pin member 114 from passing through the aperture 92 in the cleaning member 70.

The inner portion 122 of the nylon pin member's shaft 126 has a diameter D5 which is smaller than both the diameter D4 of the end portion 130 of the nylon pin member 114, and the diameter D3 of the aperture 92 in the back surface 96 of the cleaning member 70. Due to the diameter differences, the inner portion 122 of the nylon pin member's shaft 126 is allowed to pass at least partially through both of the apertures 80 and 92 of the cleaning member 70. The diameter D6 of the spring 118, when it is extended around the inner portion 122 of the nylon pin member's shaft 126, is larger than the inner portion's diameter D5. The spring 118 is held between the shoulder 132 of the end portion 130 of the nylon pin member 114 and the shoulder 98 of the cleaning member 70.

An end 134 of the pin member 114 has a cut-out section 138 in its cross-section to allow the pin member's end 134 to be compressed during insertion of the pin member 114 into the hole 68 of the base member 6. The diameter D7 of the end 134 of the pin member 114 is larger than the diameter D1 of the hole 68 in the base member 6, but smaller than the diameter D8 of a secondary hole 150 extending within the cross-section of the base member 6.

When the pin member 114 is inserted into the aperture 80 in the front surface 76 of the cleaning member 70, the end 134 of the pin member 114 is passed out of the aperture 92 in the back surface 96 of the cleaning member 70 and through the hole 68 in the base member 6. Due to the end 134 of the pin member 114 having a larger diameter D7 than the diameter D1 of the hole 68 of the base member 6, the end 134 of the pin member 114 is compressed as it passes through the hole 68 in the base member 6. As the end 134 of the pin member 114 reaches the secondary hole 150 in the cross-section of the base member 6, the end 134 of the pin member 114 expands outwardly due to the increased diameter D8 of the secondary hole 150. At that point, a shoulder 154 of the pin member's end portion 134 abuts against a shoulder 158 within the cross-section of the base member 6 to lock the pin member 114 in place, thereby preventing the pin member 114 from slipping out of the hole 68 in the base member 6. As a result, since the diameter D4 of the end portion 130 of the nylon pin member 114 is larger than the diameter D3 of the aperture 92 in the back surface 96 of the cleaning member 70, thereby preventing the end portion 130 of the nylon pin member 114 from passing through the aperture 92 in the cleaning member 70, the cleaning member 70 is securely attached to the base member 6.

The spring's 118 naturally extended state forces the ends of the spring 162 and 164 to press respectively against the shoulder 132 of the end portion 130 of the nylon pin member 114 and the shoulder 98 of the cleaning member 70. In such manner, the back surface 96 of the cleaning member 70 is fixedly secured within the horizontal pathway 52 in the front surface 50 of the base member 6, with surfaces 168 of the cleaning member 70 abutted against ridges 54 in the front surface 50 of the base member 6 thereby preventing movement. As a result, as shown in FIGS. 1 and 4, the cleaning member 70 is locked in a horizontal position against the base member 6. In other embodiments, the spring 118 may be utilized to apply a force to the cleaning member 70 towards at least one of two or more receiving surfaces defined in the base member 6. In further embodiments, other mechanisms may be used in place of the spring 118 and pin member 114 to lock the cleaning member 70 in place against the base member 6.

Figure 5:
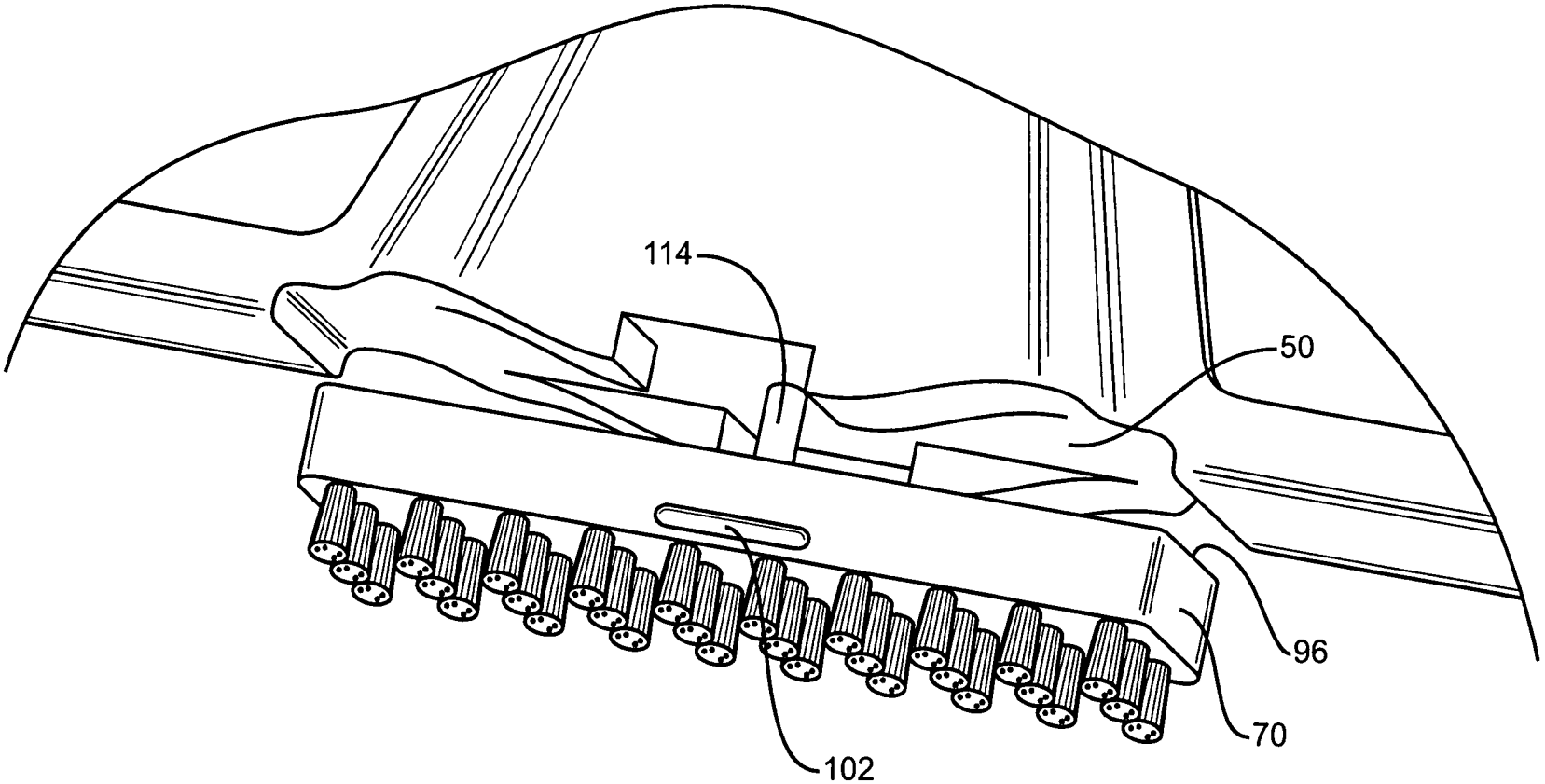
FIG. 5 is a top perspective view of the cleaning implement of FIG. 1 with the rotatable cleaning member being partially removed from the base member in order to compress the spring and rotate the cleaning member into a vertical position along the base member.

As shown in FIG. 5, to change the position of the cleaning member 70 from the horizontal position of FIG. 1 to the vertical position of FIG. 6, a user grasps one or more of the gripping members 102 and 104 to pull the back surface 96 of the cleaning member 70 away from the front surface 50 of the base member 6. During this process, as can be visualized using FIG. 4, the shoulder 132 of the end portion 130 of the pin member 114 interferes with the shoulder 98 of the cleaning member 70 thereby preventing the cleaning member 70 from slipping off the pin member 114. While this occurs, the spring 118 is compressed between the shoulder 98 of the cleaning member 70 and the shoulder 132 of the end portion 130 of the nylon pin member 114.

The user then rotates the cleaning member 70 into the vertical position of FIG. 6 and releases the cleaning member 70. As visualized using FIGS. 2, 4, and 6, the spring 118 re-extends into its natural state forcing the cleaning member 70 to be aligned within the vertical pathway 58 in the front surface 50 of the base member 6. In such manner, the back surface 96 of the cleaning member 70 is fixedly secured within the vertical pathway 58 in the front surface 50 of the base member 6, with surfaces 168 of the cleaning member 70 aligned against abutments 62 in the front surface 50 of the base member 6 to prevent movement. As a result, the cleaning member 70 is locked in a vertical position against the base member 6. In other embodiments, other mechanisms may be used in place of the spring 118 and pin member 114 to allow re-positioning of the cleaning member 70.

The rotating cleaning member 70 allows a user to clean surfaces oriented in different positions by simply re-orienting the cleaning member 70 into a different position. When the cleaning member 70 is in the horizontal position of FIG. 1, the bristles 72 of the cleaning member 70 may be used to scrub wide surfaces aligned along the front surface 50 of the base member 6. In this position, the substantially perpendicular alignment of the bristles 72 of the cleaning member 70 with respect to the bristles 46 of the base member 6 allows a user to brush, scrub, or sweep horizontal or vertical surfaces utilizing two sets of differently oriented bristles 46 and 72 in different planes.

When the cleaning member 70 is in the vertical position of FIG. 6, the bristles 72 of the cleaning member 70 may be used to brush, scrub, or sweep narrow, recessed, grooved surfaces, such as grout lines in a tile floor, which are aligned perpendicularly to the front surface 50 of the base member 6. In this position, the substantially perpendicular alignment of the bristles 72 of the cleaning member 70 with respect to the bristles 46 of the base member 6 again allows a user to brush, scrub, or sweep horizontal or vertical surfaces utilizing two sets of differently oriented bristles 46 and 72.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that the appended claims, including all equivalents thereof, are intended to define the scope of the invention.

The invention claimed is:

1. A cleaning implement comprising:

a base member;

a first cleaning material attached to said base member;

a cleaning member rotatably connected to the base member;

a second cleaning material attached to said cleaning member, wherein said second cleaning material is oriented in a different plane than said first cleaning material; and a spring, wherein said spring in its naturally extended state forces said cleaning member against said base member.

2. The cleaning implement of claim 1, wherein the base member comprises foam filled Polypropylene.

3. The cleaning implement of claim 1, wherein the cleaning implement further comprises a handle, wherein said handle is attached to said base member.

4. The cleaning implement of claim 3, wherein said handle is threaded into a hole in said base member.

5. The cleaning implement of claim 3, wherein one or more stabilizing arms are attached to the handle and base member.

6. The cleaning implement of claim 1, wherein said first cleaning material comprises at least one of bristles, brush material, mop material, sponge material, scrubber material, and broom material.

7. The cleaning implement of claim 1, wherein said first cleaning material is attached to a surface of said base member, and said first cleaning material extends substantially perpendicularly from said surface.

8. The cleaning implement of claim 1, wherein said cleaning member is rotatably connected to said base member utilizing a pin.

9. The cleaning implement of claim 8, wherein said pin extends from an aperture in said cleaning member into a hole in said base member.

10. The cleaning implement of claim 9, wherein said pin is prevented from slipping out of said aperture in said cleaning member by a first shoulder of said cleaning member, and said pin is prevented from slipping out of said hole in said base member by a second shoulder of said base member.

11. The cleaning implement of claim 8, wherein said pin is made of nylon.

12. The cleaning implement of claim 1, wherein said base member comprises at least two receiving surfaces, the receiving surfaces not being aligned with each other, wherein said at least two non-aligned receiving surfaces are adapted to receive said cleaning member against said receiving surfaces.

13. The cleaning implement of claim 12, wherein said cleaning member is adapted to rotate from a position against one of said at least two non-aligned receiving surfaces into another position against another of said at least two non-aligned receiving surfaces.

14. The cleaning implement of claim 13, wherein one of said at least two non-aligned receiving surfaces is oriented horizontally and another of said at least two non-aligned receiving surfaces is oriented vertically.

15. The cleaning implement of claim 12, wherein said at least two non-aligned receiving surfaces comprise pathways at least partially imbedded in a surface of said base member.

16. The cleaning implement of claim 12, wherein said at least two non-aligned receiving surfaces are adapted to restrain said cleaning member in at least one direction when said cleaning member is against said receiving surfaces.

17. The cleaning implement of claim 1, wherein said cleaning member comprises at least one gripping member for grasping said cleaning member and rotating said cleaning member into another position.

18. The cleaning implement of claim 1, wherein said second cleaning material comprises at least one of bristles, brush material, mop material, sponge material, scrubber material, and broom material.

19. The cleaning implement of claim 1, wherein said second cleaning material is attached to a surface of said cleaning member, and said second cleaning material extends substantially perpendicularly from said surface.

20. The cleaning implement of claim 1, wherein said first cleaning material extends in a plane non-parallel to another plane in which the second material extends.

21. A cleaning implement comprising:

a handle;

a base member connected to the handle;

a first cleaning material attached to said base member;

a cleaning member rotatably attached to said base member;

two or more receiving surfaces defined in said base member;

a second cleaning material attached to said cleaning member, wherein the cleaning member is adapted to rotate relative to the base member for positioning said cleaning member into two or more cleaning positions relative to said base member; and wherein when disposed in said two or more cleaning positions said cleaning member abuts against at least one of said two or more receiving surfaces in said base member and said two or more receiving surfaces restrain said cleaning member from rotation.

22. The cleaning implement of claim 21 further comprising a pin, wherein said pin aids in attaching said cleaning member to said base member.

23. The cleaning implement of claim 21, wherein said two or more receiving surfaces comprise pathways at least partially imbedded in said base member.

24. The cleaning implement of claim 21, wherein said second cleaning material is oriented in a different plane than said first cleaning material.

25. The cleaning implement of claim 21 further comprising a spring, wherein said spring in its naturally extended state is adapted to apply a force to the cleaning member towards at least one of said two or more receiving surfaces.

26. The cleaning implement of claim 21, wherein one of said two or more receiving surfaces is in a horizontal configuration and another of said two or more receiving surfaces is in a vertical configuration.

27. The cleaning implement of claim 21, wherein each of said first and second cleaning materials comprise at least one of bristles, brush material, mop material, sponge material, scrubber material, and broom material.

28. A method of cleaning utilizing a cleaning implement, the method comprising:

providing a cleaning implement including a base member, a first cleaning material attached to the base member, a cleaning member connected to the base member, a second cleaning material attached to the cleaning member, a first receiving surface defined in the base member, and a second receiving surface defined in the base member, rotating the cleaning member into a first cleaning position relative to said base member such that the cleaning member abuts the first receiving surface and the first receiving surface restrains the cleaning member from rotation; and rotating the cleaning member into a second cleaning position relative to said base member such that the cleaning member abuts the second receiving surface and the second receiving surface restrains the cleaning member from rotation.

29. The method of claim 28, wherein said second cleaning material is oriented in a different plane than said first cleaning material.

30. The method of claim 28, wherein said first cleaning position is horizontal and said second cleaning position is vertical.

31. The method of claim 28, wherein the first and second receiving surfaces comprise pathways.

32. A cleaning implement comprising:

a handle;

a base member connected to the handle;

a first cleaning material attached to said base member;

a cleaning member rotatably attached to said base member;

two or more receiving surfaces defined in said base member;

a second cleaning material attached to said cleaning member, wherein the cleaning member is adapted to rotate relative to the base member for positioning said cleaning member into two or more cleaning positions relative to said base member; and a spring, wherein said spring in its naturally extended state is adapted to apply a force to the cleaning member towards at least one of said two or more receiving surfaces.

33. The cleaning implement of claim 32 further comprising a pin, wherein said pin aids in attaching said cleaning member to said base member.

34. The cleaning implement of claim 32, wherein said two or more receiving surfaces comprise pathways at least partially imbedded in said base member.

35. The cleaning implement of claim 32, wherein said at least two or more receiving surfaces are adapted to restrain said cleaning member in at least one direction when said cleaning member is disposed in said two or more cleaning positions.

36. The cleaning implement of claim 32, wherein said second cleaning material is oriented in a different plane than said first cleaning material.

37. The cleaning implement of claim 32, wherein one of said two or more receiving surfaces is in a horizontal configuration and another of said two or more receiving surfaces is in a vertical configuration.

38. The cleaning implement of claim 32, wherein each of said first and second cleaning materials comprise at least one of bristles, brush material, mop material, sponge material, scrubber material, and broom material.

* * * * *